US009839572B2

(12) United States Patent
Howson

(10) Patent No.: US 9,839,572 B2
(45) Date of Patent: Dec. 12, 2017

(54) PORTABLE THERAPEUTIC APPARATUS

(71) Applicant: MyoROM Sports Med II, LLC, Northwood, ND (US)

(72) Inventor: Chris Howson, Northwood, ND (US)

(73) Assignee: MyoROM Sports Med II, LLC, Northwood, ND (US)

( * ) Notice: Subject to any disclaimer, the term of this patent is extended or adjusted under 35 U.S.C. 154(b) by 192 days.

(21) Appl. No.: 14/714,375

(22) Filed: May 18, 2015

(65) Prior Publication Data

US 2016/0338899 A1 Nov. 24, 2016

(51) Int. Cl.

*A61H 7/00* (2006.01)
*A61H 1/00* (2006.01)
*A61H 23/06* (2006.01)

(52) U.S. Cl.

CPC ..... *A61H 7/001* (2013.01); *A61H 1/00* (2013.01); *A61H 1/006* (2013.01); *A61H 1/008* (2013.01); *A61H 7/003* (2013.01); *A61H 23/06* (2013.01); *A61H 7/007* (2013.01); *A61H 2201/018* (2013.01); *A61H 2201/0153* (2013.01); *A61H 2201/0157* (2013.01); *A61H 2201/0192* (2013.01); *A61H 2201/1635* (2013.01); *A61H 2201/1664* (2013.01)

(58) Field of Classification Search

CPC ..... A61H 1/00; A61H 1/0292; A61H 1/0296; A61H 1/008; A61H 1/006; A61H 2023/002; A61H 2023/004; A61H 2023/006; A61H 23/06; A61H 2205/04; A61H 2205/125; A61H 39/00; A61H 39/02; A61H 39/04; A61H 2201/0173; A61H 2201/0176; A61H 2201/123; A61H 2201/1253; A61H 2201/1623; A61H 2201/1609; A61H 2201/1619

USPC ..... 606/237–239

See application file for complete search history.

(56) References Cited

U.S. PATENT DOCUMENTS

| | | | | |
|---|---|---|---|---|
| 1,001,175 A | | 8/1911 | Siebert, Jr. | |
| 1,722,662 A | | 7/1929 | David | |
| 2,421,354 A | * | 5/1947 | Reiter | A61C 3/08 433/151 |
| 3,228,392 A | | 1/1966 | Speyer | |
| 3,706,309 A | * | 12/1972 | Toftness | A61H 39/04 606/238 |

(Continued)

FOREIGN PATENT DOCUMENTS

| | | | | |
|---|---|---|---|---|
| DE | 29912758 U1 * | 10/1999 | | A61H 23/06 |
| WO | WO-2016187206 A1 | 11/2016 | | |

OTHER PUBLICATIONS

English translation for DE 29912758 U1, espacenet.com, captured on Apr. 12, 2017.*

(Continued)

*Primary Examiner* — Justine Yu
*Assistant Examiner* — Tu Vo
(74) *Attorney, Agent, or Firm* — Schwegman Lundberg & Woessner, P.A.

(57) ABSTRACT

A portable therapeutic apparatus is disclosed. The portable therapeutic apparatus may include a handle, a protrusion, a resistance element, and an adjustment element attached to the handle. The handle may include a first slot that houses the resistance element. The protrusion may include an indentation. The resistance element may include an elastic element.

21 Claims, 7 Drawing Sheets

(56) References Cited

U.S. PATENT DOCUMENTS

| | | | | |
|---|---|---|---|---|
| 4,116,235 | A | 9/1978 | Fuhr et al. | |
| 4,498,464 | A | 2/1985 | Morgan, Jr. | |
| 4,669,454 | A * | 6/1987 | Shamos | A61H 1/008 173/120 |
| 4,716,890 | A * | 1/1988 | Bichel | A61H 23/04 601/108 |
| 5,626,615 | A * | 5/1997 | Keller | A61H 1/008 601/107 |
| 5,656,017 | A * | 8/1997 | Keller | A61H 1/008 601/107 |
| 5,662,686 | A * | 9/1997 | Newsum | A61H 23/06 30/367 |
| 5,954,750 | A * | 9/1999 | Steffensmeier | A61G 13/009 606/237 |
| 6,379,375 | B1 * | 4/2002 | Fuhr | A61H 1/008 601/107 |
| 7,351,897 | B2 | 4/2008 | Woods | |
| 8,357,108 | B2 | 1/2013 | Taylor | |
| 8,705,492 | B2 | 4/2014 | Yomo et al. | |
| 2009/0005812 | A1 | 1/2009 | Fuhr | |
| 2014/0188169 | A1 | 7/2014 | Jacobs | |
| 2017/0065480 | A1 | 3/2017 | Howson | |

OTHER PUBLICATIONS

English translation for DE 29912758, espacenet.com, translated on Aug. 16, 2017.*

"Extremity Drop / Speeder Board", Thuli Tables—Fine Chiropractic Products, downloaded on Internet on Jun. 22, 2015 at http://thulitables.com/products/extremity-drop-thuli-table-accessory/, 2 pgs.

"CAT®—Chiropractic Adjusting Tool Family", Downloaded on Internet Jun. 22, 2015 at http://jtechmedical.com/CAT-chiropractic-Adjusting-Tool-Family/cat-family, 5 pgs.

"CAT® EX—Extended Thrust Chripractic Adjusting Tool", Downloaded on Internet Jun. 22, 2015 at http://www.jtechmedical.com/CAT-Chiropractice-Adjusting-Tool-Family/cat-ex-extended-thrust-chiropractice-adjusting-tool, 3 pgs.

"CAT® LT—Low Thrust Chiropractic Adjusting Tool", Downloaded on Internet Jun. 22, 2015 at http://www.jtechmedical.com/CAT-Chiropractic-Adjusting-Tool-Family/cat-lt-low-thrust-chiropractic-adjusting-tool, 3 pgs.

"CAT® Pro Select", Downloaded on Internet Jun. 22, 2015 at http://www.jtechmedical.com/CAT-Chiropractic-Adjusting-Tool-Family/cat-pro-select, 3 pgs.

"Straight Drop with Adjustable Tension", Extremity Drop / Speeder Board, taken from Thuli Tables on Jun. 22, 2015. www.thulitables.com, 1 pg.

"Straight Drop with Adjustable Tension", Extremity Drop / Speeder Board, taken from Thuli Table, www.thuli.com on Jun. 22, 2015., 1 pg.

"The Original Cat® - Chiropractic Adjusting Tool", Downloaded on Internet Jun. 22, 2015 at http://www.jtechmedical.com/CAT-Chiropractice-Adjusting-Tool-Family/cat-chiropractic-adjusting-tool, 3 pgs.

Hammer, Warren, "Extremity Drop Uses", Excerpt from textbook Functional Soft Tissue Examination and Treatment by Manual Methods, at least as early as Feb. 15, 2007, 5 pgs.

"International Application Serial No. PCT/US2016/032888, International Search Report dated Aug. 16, 2016", 2 pgs.

"International Application Serial No. PCT/US2016/032888, Written Opinion dated Aug. 16, 2016", 7 pgs.

* cited by examiner

PORTABLE THERAPEUTIC APPARATUS

TECHNICAL FIELD

This disclosure generally relates to therapeutic apparatuses including, physical therapy, and/or athletic training apparatuses.

BACKGROUND

Following muscular injury or repetitive strain, scar tissue or disorganized collagen often forms in the body. This aberrant tissue can restrict normal range of motion and slow healing. It is often difficult, painful, and time-consuming to release these areas of adhesion. Currently, chiropractors use large, cumbersome drop mechanisms that are attached to a table to treat areas of adhesion or hands on methods that are time-consuming, painful for the patient, and often a source of repetitive strain for the treating physician.

SUMMARY

In an example, this disclosure is directed to a portable therapeutic apparatus. The portable therapeutic apparatus can include a handle, a protrusion, an adjustment element, and a resistance element. The handle may define a first slot and a second slot. The protrusion may include a first end, a second end, and an indentation proximate the first end. The first end may be slideably located inside the first slot. The adjustment element may protrude from the second slot. The resistance element may be in contact with the adjustment element and the protrusion. When the protrusion is in a first position a portion of the resistance element may rest within the indentation and may hinder movement of the protrusion within the first slot.

In yet another example, this disclosure is directed to a method for applying a force to a desired area of a body in order to release muscular adhesions. The method may include setting a resistance force needed to cause a protrusion protruding from a handle to slide within a slot of the handle; applying a force to the handle while the protrusion rests against the desired area of the body; and upon the force being applied to the handle exceeding the resistance force, causing the protrusion to rapidly slide from a first position within the slot to a second position within the slot. Upon the protrusion reaching the second position, the force may be applied to the desired area of the body.

BRIEF DESCRIPTION OF THE FIGURES

The accompanying drawings, which are incorporated in and constitute a part of this disclosure, illustrate various embodiments of the present invention.

DETAILED DESCRIPTION

Figure 1A:
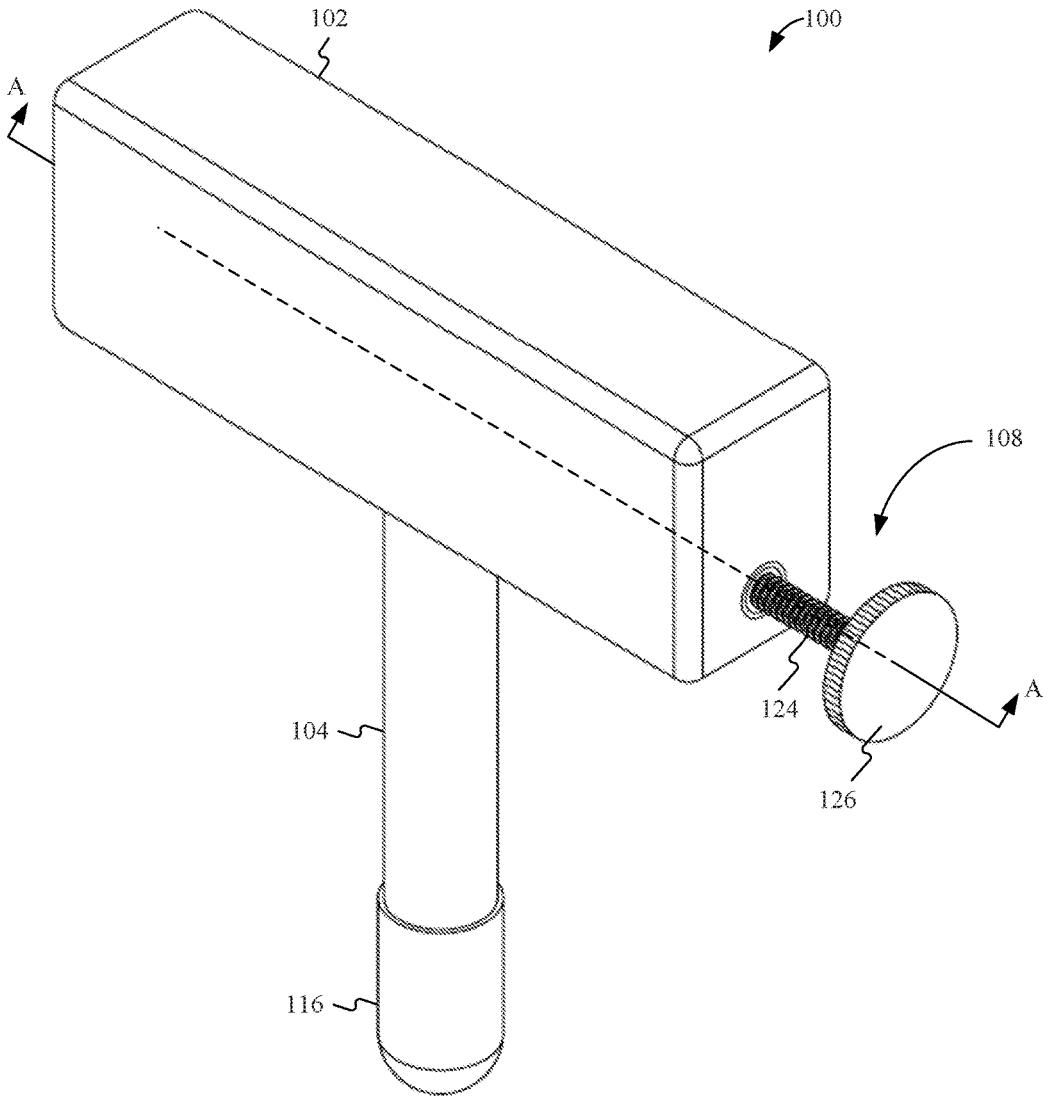
FIG. 1A shows a perspective view of a portable therapeutic device.

The following detailed description refers to the accompanying drawings. Wherever possible, the same reference numbers are used in the drawings and the following description to refer to the same or similar elements. While specific embodiments may be described herein, modifications, adaptations, and other implementations of the specific embodiments are possible and contemplated. For example, substitutions, additions, or modifications may be made to the embodiments, including elements shown in the embodiments, illustrated in the drawings, and the methods described herein may be modified by substituting, reordering, or adding stages to the disclosed methods. Accordingly, the following detailed description does not limit the disclosure.

Portable therapeutic apparatuses disclosed herein can provide a quick way of releasing adhesions by allowing a user to apply a stretch to the tissue that can have a mechanical effect of releasing the adhesion and also can neurologically stimulate reflex relaxation of the tissue. Use of portable therapeutic apparatuses disclosed herein can reduce the time of treatment and can confine discomfort to a very brief moment, rather than a prolonged therapy session.

A problem with currently used drop pieces is that most are stationary and difficult to transport as they are either attached to a table or otherwise cumbersome to transport. In order to trigger a drop, a thrust must be applied in a downward direction, which can be difficult depending on the tissue involved. Currently used drop pieces are large and stationary, requiring the person to lie down. They also limit the body areas one can treat due to the location and direction of the drops. Other manual methods for applying a stretch are painful, hard to tolerate, and are stressful to the user over time.

Portable therapeutic apparatuses consistent with this disclosure may allow the application of a force in the direction of a user's thrust, regardless of a person's body positioning. Portable therapeutic apparatuses consistent with this disclosure also offer portability and versatility that can make portable therapeutic apparatuses consistent with this disclosure both convenient and effective. Portable therapeutic apparatuses consistent with this disclosure are also less taxing to the user, as the portable therapeutic apparatuses consistent with this disclosure can be triggered by using one's body weight rather than the force of thumbs or hands. Treatment using the portable therapeutic apparatuses consistent with this disclosure may also be completed much quicker, thus making the treatment more tolerable.

Consistent with this disclosure, portable therapeutic apparatuses may include a handle having a block shape, a first hole extending centrally within the handle, a second hole extending transverse with respect to the first hole and extending into the first hole. The portable therapeutic apparatuses consistent with this disclosure may also include a rod slidably extending within the first hole, a groove extending around the inner end of the rod, and a softer tip attached to a distal end of the rod. A first ball bearing may be positioned within the second hole to selectively engage the groove in the rod. A spring positioned within the second hole may apply a biasing force to the first ball bearing to engage the groove. A second ball bearing on the opposite side of the spring may rest against a threaded insert extending into the second hole to retain the spring at a minimum level of biasing force. The threaded knob may threadably extend through the threaded insert to engage the second ball bearing thereby allowing for an increase in biasing force by the spring to the first ball bearing. In use, a user applies a downward pressure upon a location of a body with the tip of the rod engaging the location to be treated. As the downward force is applied to the body, the rod eventually pushes upwardly until the groove is no longer engaged by the first ball bearing and the handle continues downwardly to engage the top end of the rod thereby applying a quick impulse to the tissue being treated. The rod is then pulled out of the first hole until the first ball bearing engages the groove and the above process can be repeated. Throughout this disclosure, a user includes, but is not limited to any person utilizing the portable therapeutic apparatus disclosed herein. Non-limiting examples of a user include a chiropractor, a physical therapist, an athletic trainer, an athlete, a person at home or at work, a massage therapist, a veterinarian, etc. Users can use the therapeutic apparatus on themselves or on others such as patients.

Figure 1B:
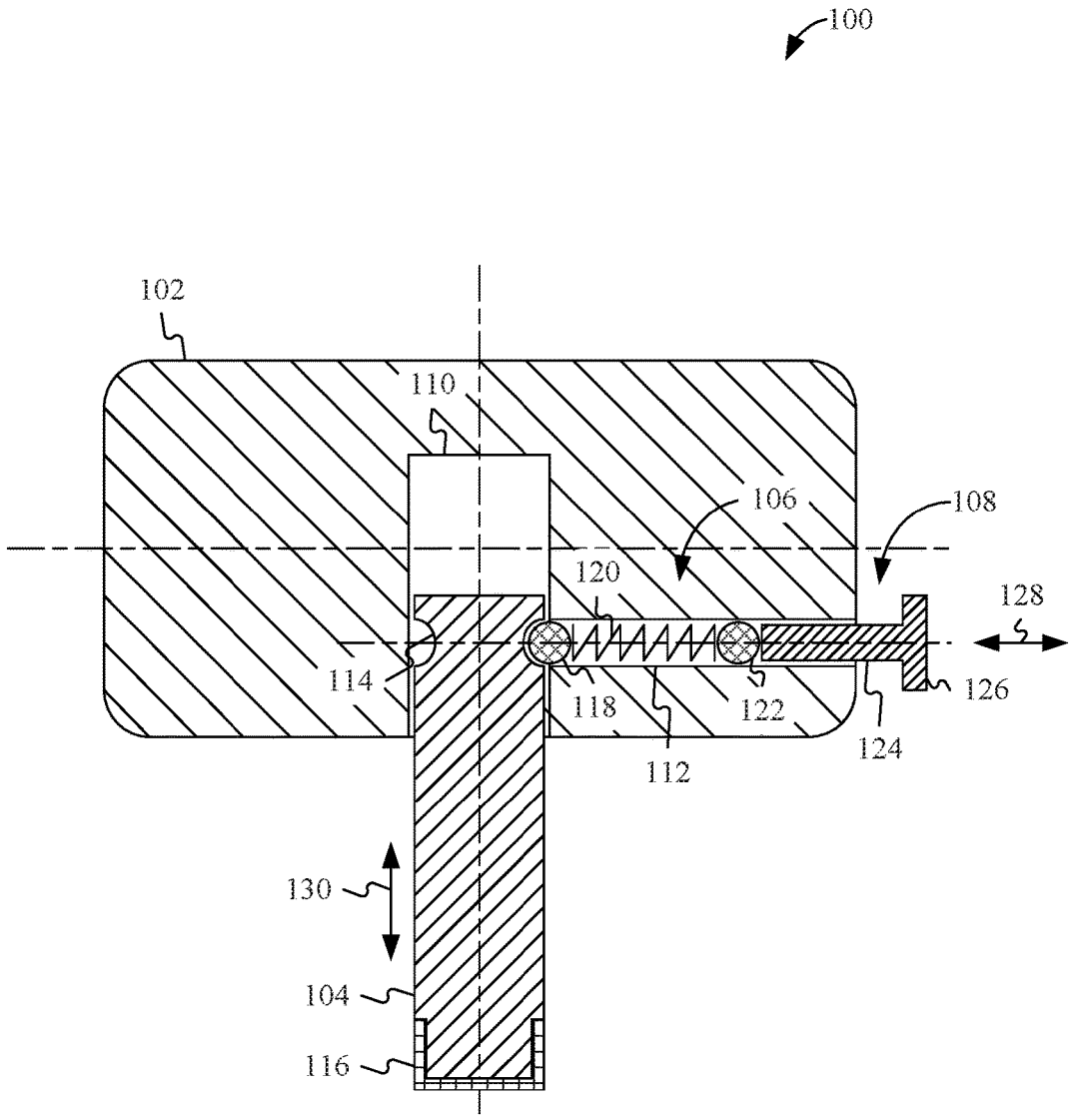
FIG. 1B shows a cross-section of an example of a portable therapeutic apparatus with a protrusion in a first position across section A-A of FIG. 1A.
Figure 1C:
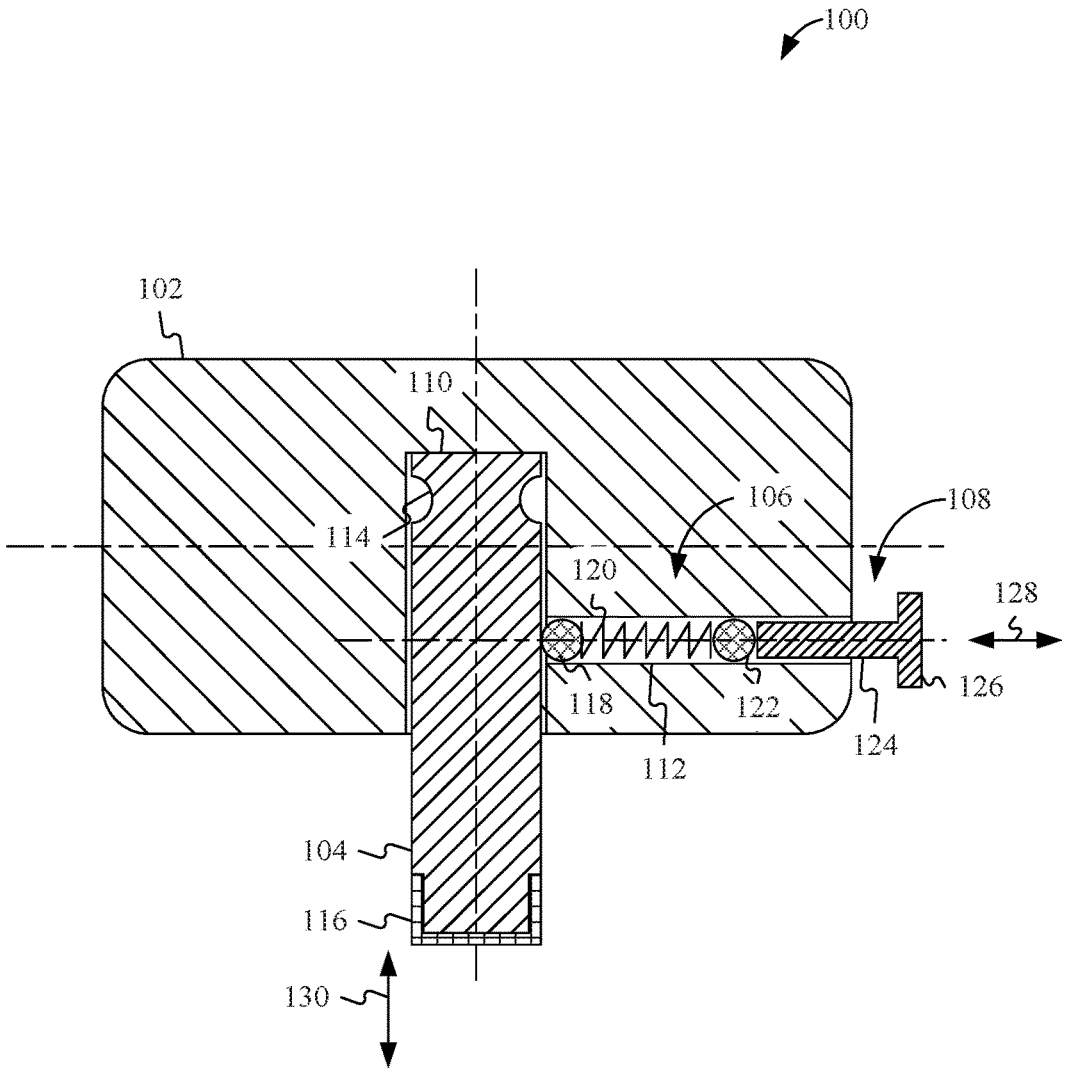
Figure 1C shows a cross-section of an example of a portable therapeutic apparatus of FIG. 1B with the protrusion in a second position across section A-A of FIG. 1A.

FIGS. 1A through 1C show an example of a portable therapeutic apparatus 100, in accordance with this disclosure. In the example of FIGS. 1A through 1C, the portable therapeutic apparatus 100 can include a handle 102, a protrusion 104, a resistance element 106, and an adjustment element 108. The handle 102 can include a first slot 110 and a second slot 112. The protrusion 104 can include an indentation 114 and a cushion or end cap 116. The resistance element 106 can include a first element 118, an elastic element 120, and a second element 122. In some examples, one or both of the first and second elements 118, 122 can be spherical such as ball bearings. In other example configurations, one or both of the first and second elements 118, 122 can be differing shapes. Non-limiting shapes of the first and second elements 118, 122, include, but are not limited to, conical, cylindrical, oblong, etc. In addition, the first element 118 can be a different shape than the second element 122. The adjustment element 108 can include a threaded portion 124 (e.g., a threaded rod) connected to a cap 126. Non-limiting examples of a slot as used herein include, but are not limited to, any opening, cavity, groove, hole or the like in the handle 102.

The handle 102 can be constructed of a number of different materials. Non-limiting examples of materials that can be used to construct the handle 102 include, but are not limited to, woods, ceramics, metals, polymers, or any combination thereof. For example, the handle 102 can be constructed from a block of wood. For instance, the handle 102 can be constructed from a block of oak or other species of wood.

The handle 102 can be constructed via a number of different manufacturing techniques. For example, the handle 102 can be manufactured from a polymer that is injection molded, from a metal that is cast or forged, etc. Other methods for manufacturing the handle 102 include milling the handle 102, regardless of the material used to form an ingot, on a computer numerically controlled (CNC) mill. For example, the ingot for the handle 102 may be manufactured by cutting blocks of wood into rectangular prisms of approximately the correct size of a finished handle. Once the ingot is formed, a CNC mill may bore the first slot 110 in a top surface, the second slot 112 in a side surface, as well as round off the edges to eliminate sharp points that could injure a user. In addition, the handle 102 can be hand crafted using hand tools such as chisels, rasps, etc.

In addition, the handle 102 may be custom fitted to the user. For example, a mold or other template can be created for a user's hands. The mold or template can be used to cast or otherwise form the handle 102 such that the handle 102 better conforms to the user's hands.

The protrusion 104 can be constructed of different materials. Non-limiting examples of materials that can be used to construct the protrusion 104 include, but are not limited to, woods, ceramics, metals, polymers, and combinations thereof. For example, the protrusion 104 may be formed in the shape of a cylinder from a metal (such as aluminum), polymer (such as nylon), ceramic (such as clay), wood (such as oak), etc. The cylinder may or may not contain voids. For instance, as will be described with regards to FIG. 4, a portion of the protrusion 104 may be hollow. In addition, different protrusions may be formed of different materials to allow customization of a treatment program. For example, during a first phase of treatment a first protrusion constructed of a stiff material (i.e., a high Young's modulus) may be utilized and during a second phase of treatment a second protrusion constructed of a less stiff material (i.e., a low Young's modulus) may be utilized.

The protrusion 104 can be constructed in a variety of fashions. For example, the protrusion 104 can be cast, injection molded, milled on a CNC mill, turned on a lathe, etc. For instance, the protrusion 104 can be constructed of a polymer by injection molding. The indentation 114 can be formed at a first end of the protrusion 104 during the injection molding process. Furthermore, the protrusion 104 can be constructed of a polymer rod and the indentation 114 can be cut into the polymer rod on a lathe. The cushion 116 can simply slip over a second end of the protrusion 104. The cushion 116 can be constructed of materials such as, but not limited to, rubber, ceramics, polymers, etc.

The indentation 114 can take many shapes. For instance, the indentation 114 can be a dimple located on the protrusion 104 or the indentation 114 can be a groove covering the full or a partial circumference of the protrusion 104. In addition, while FIGS. 1B and 1C shows a single indentation in the form of a groove around the entire circumference of the protrusion 104, multiple indentations can be formed on the surface of the protrusion 104. The multiple indentations can be the same size and shape or can be different sizes and shapes. For example, a first indentation may be a first groove having a first dimension and a second indentation may be a second groove having a second dimension. Furthermore, a first indentation may be a dimple located on the surface of the protrusion 104 and a second indentation may be a groove.

As shown in FIG. 1B, when the protrusion 104 is in a first position, a portion of the resistance element 106 can rest within a portion of the indentation 114. The portion of the resistance element 106 resting within the indentation 114 can hinder the protrusion 104 from freely moving within the first slot 110. For example, as shown in FIG. 1B, a portion of the first element 118 can rest within a portion of the indentation 114. The amount of force needed to move the protrusion 104 within the first slot 110 is dependent upon factors including, but not limit to, how much of the resistance element 106 rests within the indentation 114, the amount of force the resistance element 106 applies to the protrusion 104, the sizes of the indentation 114 and the resistance element 106, the shapes of the indentation 114 and the resistance element 106, etc.

The resistance element 106 can be constructed from a variety of materials and in a number of fashions. As shown in FIGS. 1B and 1C, the resistance element 106 can include the first element 118, the elastic element 120, and the second element 122. However, the resistance element 106 could include only the elastic element 120. For example, the elastic element 120 could be constructed of an elastic material such that force applied to the elastic element 120, via the adjustment element 108 for example, can be translated into a force that can be applied to a portion of the indentation 114 contacted by the elastic element 120. For instance, the elastic element 120 can be made of a material with a low poisson ratio (e.g., cork) and when a force is applied to the elastic element 120 in an axial direction very little radial deformation occurs and the force applied to the elastic element 120 can be translated to the indentation 114. In addition, materials with high poisson ratios (e.g. rubber) can also be used as the elastic element 120. For example, the elastic element 120 may include a rubber portion that can be encased within a sleeve (not shown in FIGS. 1A through 1C) that can slide within the second slot 112. When a force is applied to the elastic element 120 in an axial direction the radial expansion of the rubber portion of the elastic element 120 can be constrained by the sleeve and the force can be directed to the protrusion 104.

In addition to materials such as cork and rubber, springs may be used as the elastic element 120. The elastic element 120 can also be selected from a plurality of elastic elements. For instance, the elastic element 120 can be a compression spring that is selected from a plurality of compression springs. In some example configurations, each of the compression springs can have a different spring constant. The differing spring constants can allow the user to select a compression spring that can result in a higher or lower force being required to be applied to the handle 102 in order to cause the protrusion 104 to traverse within the first slot 110.

A single elastic element can be used to customize the force required to cause the protrusion 104 to traverse within the first slot 110. For example, the elastic element 120 can be a compression spring located between the first element 118 and the second element 122. To increase or decrease the force required to cause protrusion 104 to move, the user can rotate the cap 126 clockwise or counterclockwise, respectively, to compress or decompress the elastic element 120.

During use, a user may wish to apply a given pressure to an area of a person's body using the portable therapeutic apparatus 100. During using the user can set a first desired pressure by adjusting the adjustment element 108. More specifically, the user can turn the cap 126 to cause the threaded rod 124 to move into or out of the handle 102 as indicated by arrow 128. The threaded rod 124 may include markings that are calibrated to result in given forces being required to cause the protrusion 104 to move. For instance, to apply the first desired pressure, the user may rotate the cap 126 until a first marking located on the threaded rod 124 is proximate the handle 102. The user may then place the second end of the protrusion 104 on the desired area to be treated. Once the protrusion 104 is in contact with the desired area to be treated, the user can apply a force to the handle 102. As shown in FIG. 1C, when the force applied to the handle 102 exceeds the first desired force, the first indentation 114 can force the first element 118 from the indentation 114 and into the second slot 112. Once the first element 118 clears the indentation 114, the protrusion 104 can move toward the top of the handle 102 within the first slot as indicated by arrow 130. As the handle 102 travels towards the protrusion 104, force against the portion of the body being treated lessens until the protrusion 104 reaches the bottom of the first slot 110. Upon the protrusion 104 reaching the bottom of the first slot 110, the handle 102 can impact, as shown in FIG. 1C, the protrusion 104. The impact can result in an impact force being applied to the desired area of the body. In other words, the handle 102 impacting the protrusion 104 can result in a temporary spike in the force being applied to the desired area of the body. The temporary spike in the force can aid in stretching muscle fibers and otherwise assist in treating the person.

To apply a second desired force, the user can adjust the adjustment element 108 (e.g., by rotating the cap 126) such that a second marking that indicates the second desired force is adjacent the handle 102. Upon repositioning the adjustment element 108, the user can repeat the stages outlined above to apply the second desired pressure to the desired area (or another area) of the body.

Figure 2:
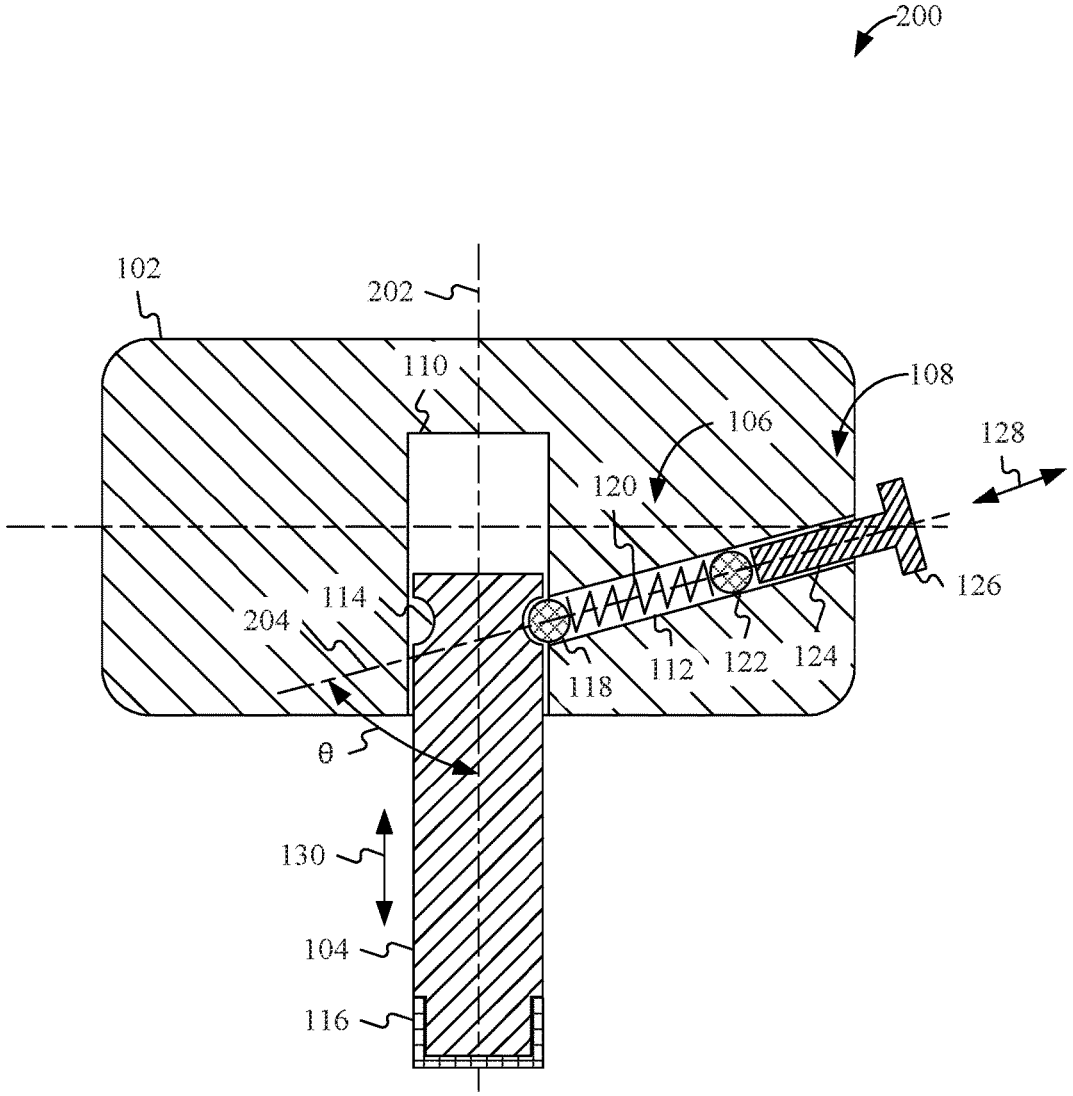
FIG. 2 shows a cross-section of another example of a portable therapeutic apparatus across a section similar to that of section A-A of the example of FIG. 1A.

FIG. 2 shows another example of a portable therapeutic apparatus 200. The portable therapeutic apparatus 200 shown in FIG. 2 is similar, in both design and construction, to the portable therapeutic apparatus 100 shown in FIGS. 1A through 1C. The difference is that centerlines for the first slot 110 and the second slot 112 in FIGS. 1A through 1C are orthogonal to one another, and in FIG. 2, a first centerline 202 for the first slot 110 and a second centerline 204 for the second slot 112 are non-orthogonal. In other words, in various embodiments consistent with this disclosure the second centerline 204 can intersect the first centerline 202 at an angle θ. Having the second slot 112 intersect the first slot 110 at an angle (e.g., θ) can allow for greater precision in setting the desired force needed to cause the indentation 114 to push the first element 118 into the second slot 112 and thus, allow the protrusion 104 of travel within the first slot 110. The greater precision is a result of the force applied by the user needed to cause movement of the first element 118 being proportional to cos(θ).

Figure 3:
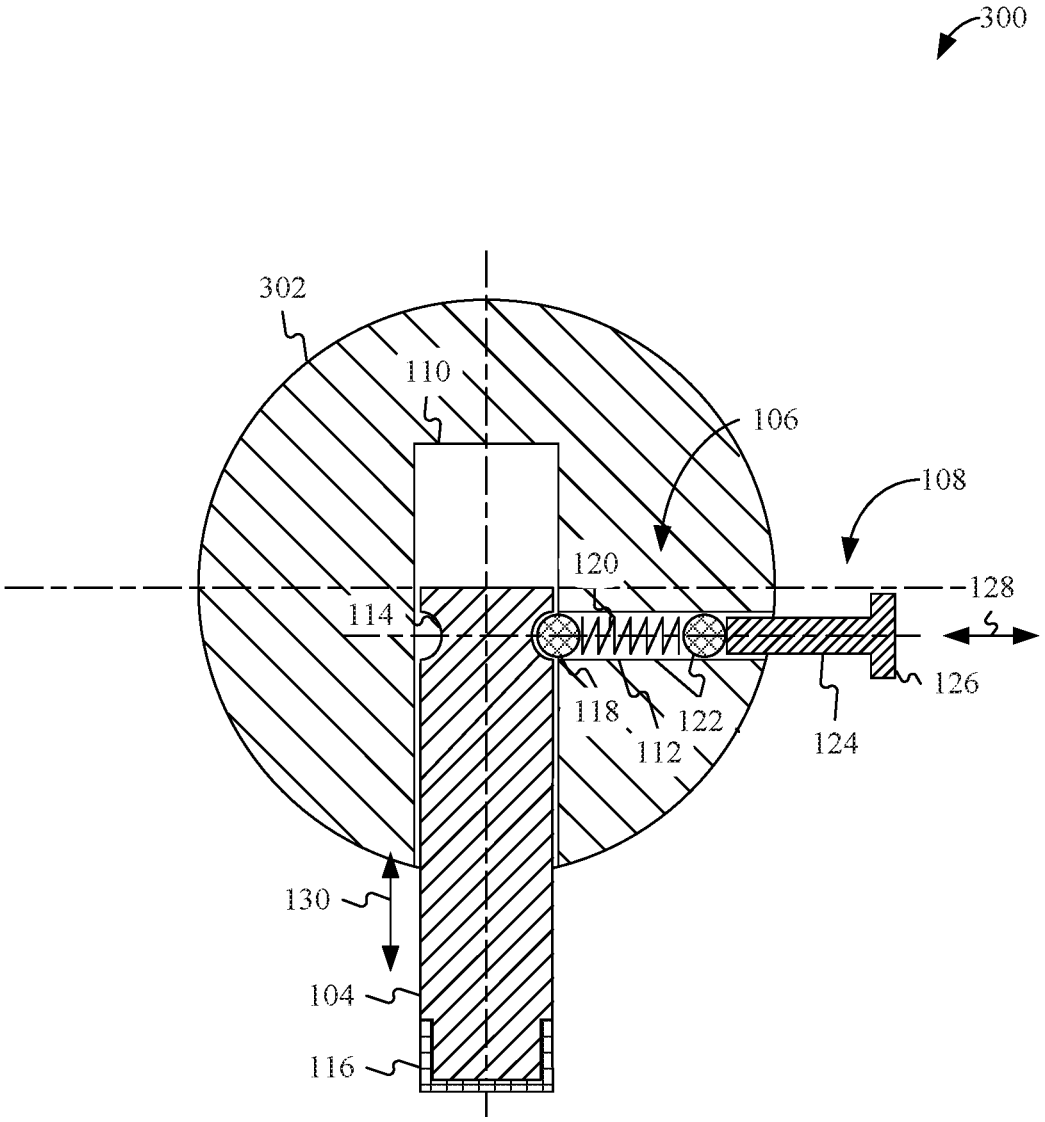
FIG. 3 shows a cross-section of another example of a portable therapeutic apparatus across a section similar to that of section A-A of the example of FIG. 1A.

FIG. 3 shows another example of a portable therapeutic apparatus 300. The portable therapeutic apparatus 300 shown in FIG. 3 is similar to the portable therapeutic apparatus 100 shown in FIGS. 1A through 1C and the portable therapeutic apparatus 200 shown in FIG. 2. The difference is that a handle 302 shown in FIG. 3 is spherical in shape. The spherical shape of the handle 302 can allow for easier gripping of the handle 302 by the user. The operation and construction of the portable therapeutic apparatus 300 is similar to the operation of the portable therapeutic apparatus 100 shown in FIGS. 1A through 1C and the portable therapeutic apparatus 200 shown in FIG. 2.

Figure 4:
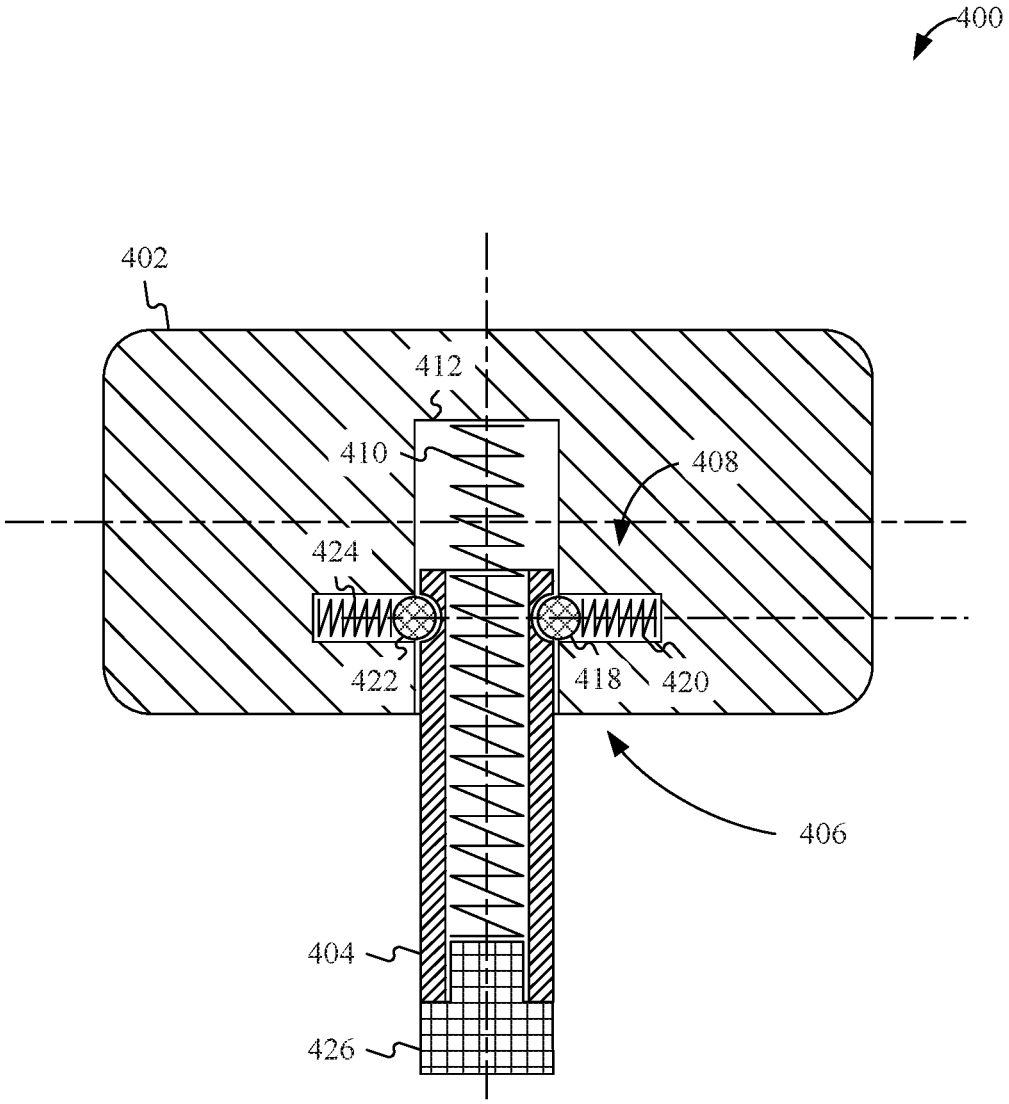
FIG. 4 shows a cross-section of another example of a portable therapeutic apparatus across a section similar to that of section A-A of the example of FIG. 1A.

FIG. 4 shows a portable therapeutic apparatus 400. The portable therapeutic apparatus 400 includes a handle 402, a protrusion 404, and a resistance element 406. The handle 402 can be constructed and customized as described above with respect to the handle 102. In addition, the handle 402 can be constructed of materials just as the handle 102. In addition, the handle 402 can have shapes similar to those shown in FIGS. 3 and 4 as well as other shapes such as, but not limited to, oblong and cylindrical. The protrusion 404 can be constructed and customized as described above with respect to the protrusion 104. In addition, the protrusion 404 can be constructed of materials just as the protrusion 104.

The resistance element 406 includes a slip element 408 and an extension element 410. As shown in FIG. 4, the slip element 408 includes a first element 418, a first elastic element 420, a second element 422, and a second elastic element 424. The first element 418 and the second element 422 may be spherical, conical, oblong, cylindrical, etc. While FIG. 4 shows the second element 422 and the second elastic element 424, embodiments can be practiced without the second element 422 and the second elastic element 424. The first elastic element 420 and the second elastic element 424 can be constructed in a similar fashion as the elastic element 120 described above.

The extension element 410 can be a tension spring or a compression spring that is selected from a plurality of tension springs or compression springs. During operation, the extension element 410 acts to counter the force applied by the user. For example, a stiff compression spring can cause the user to have to apply a greater force to the handle 402 in order to get the handle 402 to travel within a first slot 412. In other words, the force exerted by the resistance element 406 can remain constant regardless of the extension element 410 used. However, because a stiffer extension element 410 (e.g., a stiffer compression spring) can push back on the handle 402, the user may have to apply a force great enough to overcome the force exerted by the resistance element 410 plus the force of the extension element 410. Thus, once the handle 402 is able to travel within the first slot 412, the user may be applying a greater force to the handle 402 than if the user were using a less stiff extension element 410, or no extension element 410. To change the extension element 410, the user can remove a cap 426 and replace the extension element 410 that can fit within a hollow portion of the protrusion 404. In embodiments without a hollow protrusion, the extension element 410 can fit against an end portion of the protrusion 404. The extension element 410 also serves to provide resistance against the movement of the protrusion 404 when sliding in the first slot 412. This can be beneficial with certain individuals. An extension element can also be used with the embodiments shown in the other figures. For example, with regard to FIGS. 1A through 1C, an extension element can be located between the bottom of the first slot 110 and the end of the protrusion 104 in the first slot 110.

Figures 5A, 5B:
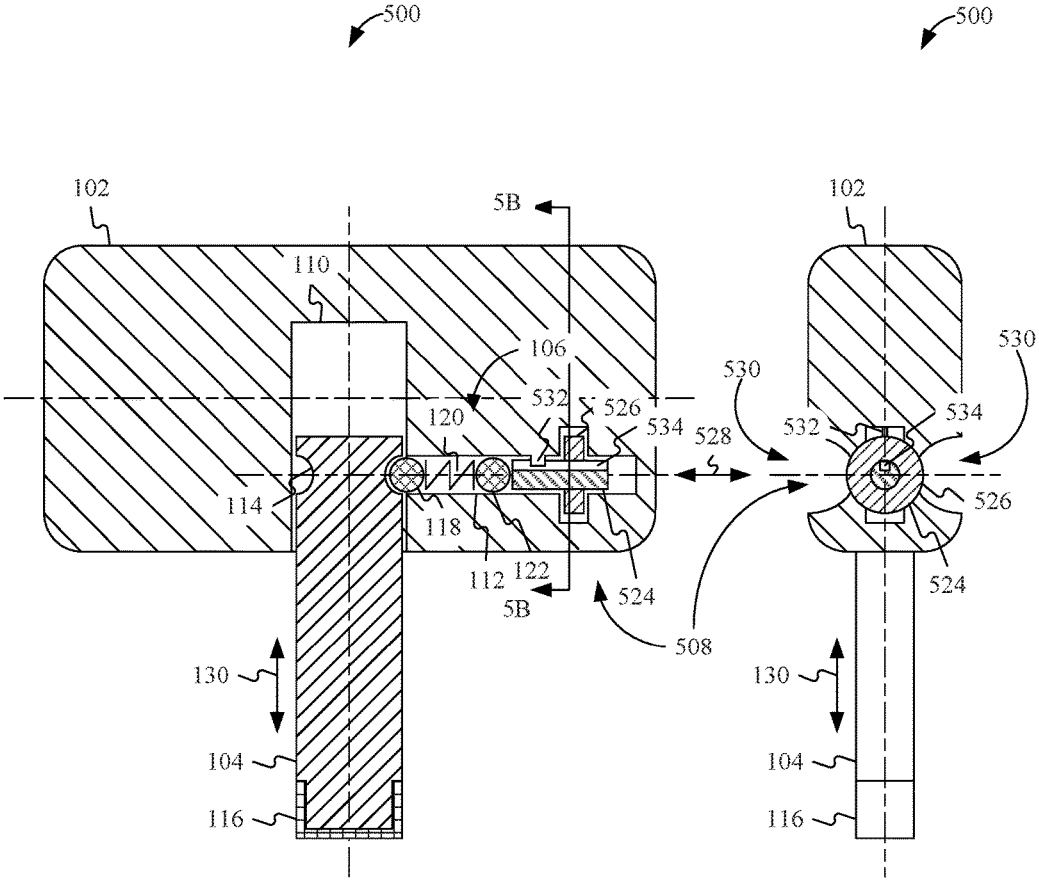
FIG. 5A shows a cross-section of another example of a portable therapeutic apparatus and FIG. 5B shows a cross-section of the portable therapeutic apparatus across section 5B-5B of FIG. 5A.

FIGS. 5A and 5B show another example of a portable therapeutic apparatus 500. The portable therapeutic apparatus 500 shown in FIGS. 5A and 5B is similar to the portable therapeutic apparatus 100 shown in FIGS. 1A through 1C, the portable therapeutic apparatus 200 shown in FIG. 2, and the portable therapeutic apparatus 300 shown in FIG. 3. However, FIGS. 5A and 5B show an adjustment element 508 that can be internal to the handle 102. The adjustment element 508 can include a threaded rod 524 that can be internal to the handle 102 and move within the second slot 112. Movement of the threaded rod 524 can be controlled by rotation of a wheel 526. One or more grooves 530 can be milled into the handle 102 such that a portion of the wheel 526 is exposed.

During use, a user can rotate the wheel 526 to cause the threaded rod 524 to move within the second slot 112 as indicated by arrow 528. To keep the threaded rod 524 from rotating when the wheel 526 is rotated, a key 532 can project from a surface of the second slot 112. The key 532 can slide within a keyway 534 formed in the threaded rod 524. The wheel 526 can include markings that are calibrated to result in given forces being required to cause the protrusion 104 to move. For instance, to apply the first desired pressure, the user may rotate the wheel 526 until a first marking located on the wheel 526 is visible in the groove 530. The first marking may correlate the first desired pressure into a force required to cause movement of the protrusion 104.

While certain embodiments of the invention have been described, other embodiments may exist. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as examples for embodiments of the invention.

The invention claimed is:

1. A portable therapeutic apparatus comprising:

a handle defining a first slot and a second slot;

a protrusion comprising a first end slideably located inside the first slot, a second end for applying force to a patient, and an indentation proximate the first end;

an adjustment element; and a resistance element in contact with the adjustment element, the adjustment element to adjust a resistance of the resistance element, the resistance element in contact with the protrusion, wherein when the protrusion is in a first position a portion of the resistance element rests within the indentation to hinder movement of the protrusion within the first slot, wherein the resistance element comprises a compression spring, and wherein the resistance element further comprises a first spherical element and a second spherical element, the first spherical element located adjacent the protrusion and adjacent to a first end of the compression spring, the second spherical element located adjacent the adjustment element and adjacent to a second end of the compression spring; and wherein when the protrusion overcomes the resistance, the protrusion slides within the first slot.

2. The portable therapeutic apparatus of claim 1, wherein the elastic element comprises a material selected from a group consisting of rubber, cork, and a polymer.

3. The portable therapeutic apparatus of claim 1, wherein a centerline of the first slot is orthogonal to a centerline of the second slot.

4. The portable therapeutic apparatus of claim 1, wherein a centerline of the first slot is non-orthogonal to a centerline of the second slot.

5. The portable therapeutic apparatus of claim 1, wherein the adjustment element comprises a threaded rod, a portion of the threaded rod located within the second slot and in contact with the resistance element.

6. The portable therapeutic apparatus of claim 1, wherein the protrusion comprises a cushion covering the second end of the protrusion.

7. The portable therapeutic apparatus of claim 1, wherein the handle is rectangular in shape and comprises a top surface and a side surface, the top surface defining at least a portion of the first slot and the side surface defining at least a portion of the second slot.

8. The portable therapeutic apparatus of claim 1, wherein the handle has a rectangular prism shape, wherein the protrusion comprises a cushion attached to the protrusion at the second end, wherein the adjustment element comprises a threaded portion and a cap, the threaded portion extending from the cap into the second slot and in contact with the second element, wherein the resistance of the resistance element is adjusted by threading the threaded portion.

9. A method for applying a force to a desired area of a body in order to release muscular adhesions, the method comprising:

setting a resistance force using an adjustment element that hinders movement of the protrusion, the resistance force transferred to a protrusion from an adjustment element, wherein the resistance force is needed to cause a protrusion protruding from a handle to slide within a slot of the handle;

applying force to the handle while the protrusion rests against the desired area of the body; and continuing to apply force to the handle until the applied force exceeds the resistance force and the protrusion slides from a first position within the slot to a second position within the slot so that the force applied to the desired area of the body lessens while the protrusion slides within the slot and then increases when the protrusion reaches the second position.

10. The method of claim 9, wherein applying the force to the handle while the protrusion rests against the desired area of the body occurs without regard to a position of the body.

11. The method of claim 9, further comprising pulling the protrusion to cause the protrusion to travel from the second position to the first position.

12. The method of claim 11, further comprising setting a second resistance force needed to cause the protrusion to slide within the slot of the handle.

13. The method of claim 9, wherein setting the resistance force comprises selecting a spring having a spring constant to provide a desired resistance force.

14. A portable therapeutic apparatus comprising:

a handle defining a first slot and a second slot, the handle having a rectangular prism shape;

a rod protruding from the handle, the rod comprising:

a first end slideably located inside the first slot, a cushion attached to the rod proximate a second end, the cushion for applying force to a portion of a body, and an indentation proximate the first end, the indentation encircling a circumference of the rod;

a resistance element in contact with the rod, the resistance element comprising:

a first spherical element contacting the rod proximate the second end, the first spherical element resting within the indentation when the rod is in a first position to hinder movement of the rod within the first slot, a second spherical element located within the second slot, and a compression spring located within the second slot and between the first spherical element and the second spherical element; and an adjustment element for adjusting a resistance of the resistance element, the adjustment element threaded into the second slot, a first end of the adjustment element in contact with the second spherical element, wherein the resistance of the resistance element is adjusted by rotating the adjustment element.

15. A portable therapeutic apparatus comprising:

a handle defining a first slot and a second slot;

a protrusion comprising a first end slideably located inside the first slot, a second end for applying force to a patient, and an indentation proximate the first end; an adjustment element; and a resistance element in contact with the adjustment element and the protrusion, wherein when the protrusion is in a first position a portion of the resistance element rests within the indentation to hinder movement of the protrusion within the first slot; and wherein the adjustment element is configured to adjust the resistance of the resistance element, wherein when the protrusion overcomes the resistance, the protrusion slides within the first slot.

16. The portable therapeutic apparatus of claim 15, wherein a centerline of the first slot is orthogonal to a centerline of the second slot.

17. The portable therapeutic apparatus of claim 15, wherein a centerline of the first slot is non-orthogonal to a centerline of the second slot.

18. The portable therapeutic apparatus of claim 15, wherein a centerline of the first slot is non-parallel to a centerline of the second slot.

19. The portable therapeutic apparatus of claim 15, wherein the adjustment element comprises a threaded rod, a portion of the threaded rod located within the second slot and in contact with the resistance element.

20. The portable therapeutic apparatus of claim 15, wherein:

the adjustment element comprises a movable member coupled to a first surface of the resistance element; and the resistance element comprises a translatable member and a second surface, wherein the second surface is the portion of the resistance element that rests within the indentation.

21. The portable therapeutic apparatus of claim 1, wherein:

the adjustment element comprises a movable member coupled to the second spherical element.

* * * * *